US010731906B2

(12) United States Patent
Dheenadayalan

(10) Patent No.: US 10,731,906 B2
(45) Date of Patent: Aug. 4, 2020

(54) CONTROLLING A COMPRESSOR OF A REFRIGERATION SYSTEM BY PREDICTING WHEN A TEMPERATURE ALARM IS TRIGGERED

(71) Applicant: International Business Machines Corporation, Armonk, NY (US)

(72) Inventor: Krishna Prabu Dheenadayalan, Bangalore (IN)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 126 days.

(21) Appl. No.: 15/938,429

(22) Filed: Mar. 28, 2018

(65) Prior Publication Data

US 2019/0301781 A1 Oct. 3, 2019

(51) Int. Cl.
*F25B 49/02* (2006.01)
*F25D 29/00* (2006.01)

(52) U.S. Cl.
CPC ..... *F25B 49/022* (2013.01); *F25D 29/001* (2013.01); *F25D 29/008* (2013.01);
(Continued)

(58) Field of Classification Search
CPC ..... F25B 49/022; F25B 2700/21; F25B 2600/02; F25B 2600/01; F25B 2500/19;
(Continued)

(56) References Cited

U.S. PATENT DOCUMENTS 6,034,607 A * 3/2000 Vidaillac ..... G01K 1/14 340/529
2011/0057803 A1* 3/2011 Yamaoka ..... H05K 7/20836 340/584

(Continued)

FOREIGN PATENT DOCUMENTS

JP 2014134348 A 7/2014

OTHER PUBLICATIONS

Taylor et al. "Predicting Alarms in Supermarket Refrigeration Systems Using Evolved Neural Networks and Evolved Rulesets," Evolutionary Computation, 2002. CEC '02. Proceedings of the 2002 Congress on, Honolulu, HI, 2002, pp. 1988-1993. doi: 10.1109/CEC.2002.1004548.

*Primary Examiner* — Larry L Furdge
(74) *Attorney, Agent, or Firm* — Cantor Colburn LLP; Richard Wilhelm

(57) ABSTRACT

Embodiments of the invention are directed to a computer-implemented method that includes determining, by a controller of a refrigeration system, an alarm zone and a non-alarm zone. The alarm zone corresponds to possible states of the refrigeration system that trigger a temperature alarm of the refrigeration system, and the non-alarm zone corresponds to possible states of the refrigeration system that do not trigger the temperature alarm. The method also includes predicting a future state of the refrigeration system. The method also includes determining whether the future state of the refrigeration system is within the alarm zone or the non-alarm zone. The method also includes generating an output data comprising a prediction of when the temperature alarm will be triggered. The method also includes triggering one or more compressors connected to the refrigeration system to improve a cooling effect.

14 Claims, 8 Drawing Sheets

(52) U.S. Cl.
CPC ..... *F25B 2500/19* (2013.01); *F25B 2600/01* (2013.01); *F25B 2600/02* (2013.01); *F25B 2700/21* (2013.01); *F25D 2500/04* (2013.01); *F25D 2600/02* (2013.01)

(58) Field of Classification Search
CPC .. F25D 29/001; F25D 29/008; F25D 2600/02; F25D 2500/04
See application file for complete search history.

(56) References Cited

U.S. PATENT DOCUMENTS

| | | | | |
|---|---|---|---|---|
| 2015/0000315 | A1* | 1/2015 | Blumhardt ..... | F25B 49/022 62/126 |
| 2017/0146287 | A1 | 5/2017 | Rezayat | |
| 2017/0219279 | A1 | 8/2017 | Chae et al. | |

* cited by examiner

| TIME IN MINUTES | TEMPERATURE ABOVE THRESHOLD |
|---|---|
| 0 | 11 |
| 20 | 8 |
| 30 | 9 |
| 40 | 8 |
| 50 | 4 |
| 60 | 6 |
| 70 | 5 |
| 80 | 4 |
| 90 | 2 |
| 100 | 2 |
| 110 | 1 |

FIG. 2

CONTROLLING A COMPRESSOR OF A REFRIGERATION SYSTEM BY PREDICTING WHEN A TEMPERATURE ALARM IS TRIGGERED

BACKGROUND

The present invention relates in general to controlling a compressor by predicting when a temperature alarm is triggered within a refrigeration system. More specifically, the present invention relates to computer systems configured to predict a triggering of a temperature alarm based on a predicted state of the refrigeration system.

Retail refrigeration systems are generally used to preserve food that is sold to consumers. Refrigeration typically removes heat from the area where the food is stored, and the removed heat is transferred to a separate area. The transfer of heat can be performed mechanically and/or electrically. Retail refrigeration systems are generally equipped with temperature sensors in order to detect the storage temperature, and retail refrigerators are also generally equipped with temperature alarms in order to notify users if the refrigerators begin using an improper storage temperature.

SUMMARY

A computer-implemented method according to one or more embodiments of the invention includes determining, by a controller of a refrigeration system, an alarm zone, and a non-alarm zone. The alarm zone corresponds to possible states of the refrigeration system that trigger a temperature alarm of the refrigeration system, and the non-alarm zone corresponds to possible states of the refrigeration system that do not trigger the temperature alarm. The method also includes predicting a future state of the refrigeration system. The future state is predicted based on at least one input determined by a temperature sensor of the refrigeration system, and the future state is predicted based on at least one input determined by a timer of the refrigeration system. The method also includes determining whether the future state of the refrigeration system is within the alarm zone or the non-alarm zone. The method also includes generating, by the controller, an output data including a prediction of when the temperature alarm will be triggered. The generating is based on whether the future state of the refrigeration system is determined to be within the alarm zone or the non-alarm zone. The method also includes triggering one or more compressors connected to the refrigeration system to improve a cooling effect.

A computer system according to one or more embodiments of the invention includes a memory and a processor system of a refrigeration system communicatively coupled to the memory. The processor system is configured to perform a method including determining an alarm zone and a non-alarm zone. The alarm zone corresponds to possible states of the refrigeration system that trigger a temperature alarm of the refrigeration system, and the non-alarm zone corresponds to possible states of the refrigeration system that do not trigger the temperature alarm. The method also includes predicting a future state of the refrigeration system. The future state is predicted based on at least one input determined by a temperature sensor of the refrigeration system, and the future state is predicted based on at least one input determined by a timer of the refrigeration system. The method also includes determining whether the future state of the refrigeration system is within the alarm zone or the non-alarm zone. The method also includes generating an output data including a prediction of when the temperature alarm will be triggered. The generating is based on whether the future state of the refrigeration system is determined to be within the alarm zone or the non-alarm zone. The method also includes triggering one or more compressors connected to the refrigeration system to improve a cooling effect.

A computer program product according to one or more embodiments of the invention includes a computer-readable storage medium having program instructions embodied therewith. The program instructions are readable by a processor system of a refrigeration system to cause the processor system to determine an alarm zone and a non-alarm zone. The alarm zone corresponds to possible states of the refrigeration system that trigger a temperature alarm of the refrigeration system. The non-alarm zone corresponds to possible states of the refrigeration system that do not trigger the temperature alarm. The processor system is also caused to predict a future state of the refrigeration system. The future state is predicted based on at least one input determined by a temperature sensor of the refrigeration system, and the future state is predicted based on at least one input determined by a timer of the refrigeration system. The processor system is also caused to determine whether the future state of the refrigeration system is within the alarm zone or the non-alarm zone. The processor system is also caused to generate an output data comprising a prediction of when the temperature alarm will be triggered. The generating is based on whether the future state of the refrigeration system is determined to be within the alarm zone or the non-alarm zone. The processor system is also caused to trigger one or more compressors connected to the refrigeration system to improve a cooling effect.

BRIEF DESCRIPTION OF THE DRAWINGS

The subject matter of one or more embodiments is particularly pointed out and distinctly defined in the claims at the conclusion of the specification. The foregoing and other features and advantages are apparent from the following detailed description taken in conjunction with the accompanying drawings in which:

FIG. 2 illustrates a chart that reflects different possible amounts of temperature by which a refrigeration temperature can exceed a threshold temperature along with corresponding threshold durations in accordance with one or more embodiments of the invention;

DETAILED DESCRIPTION

Figure 1:
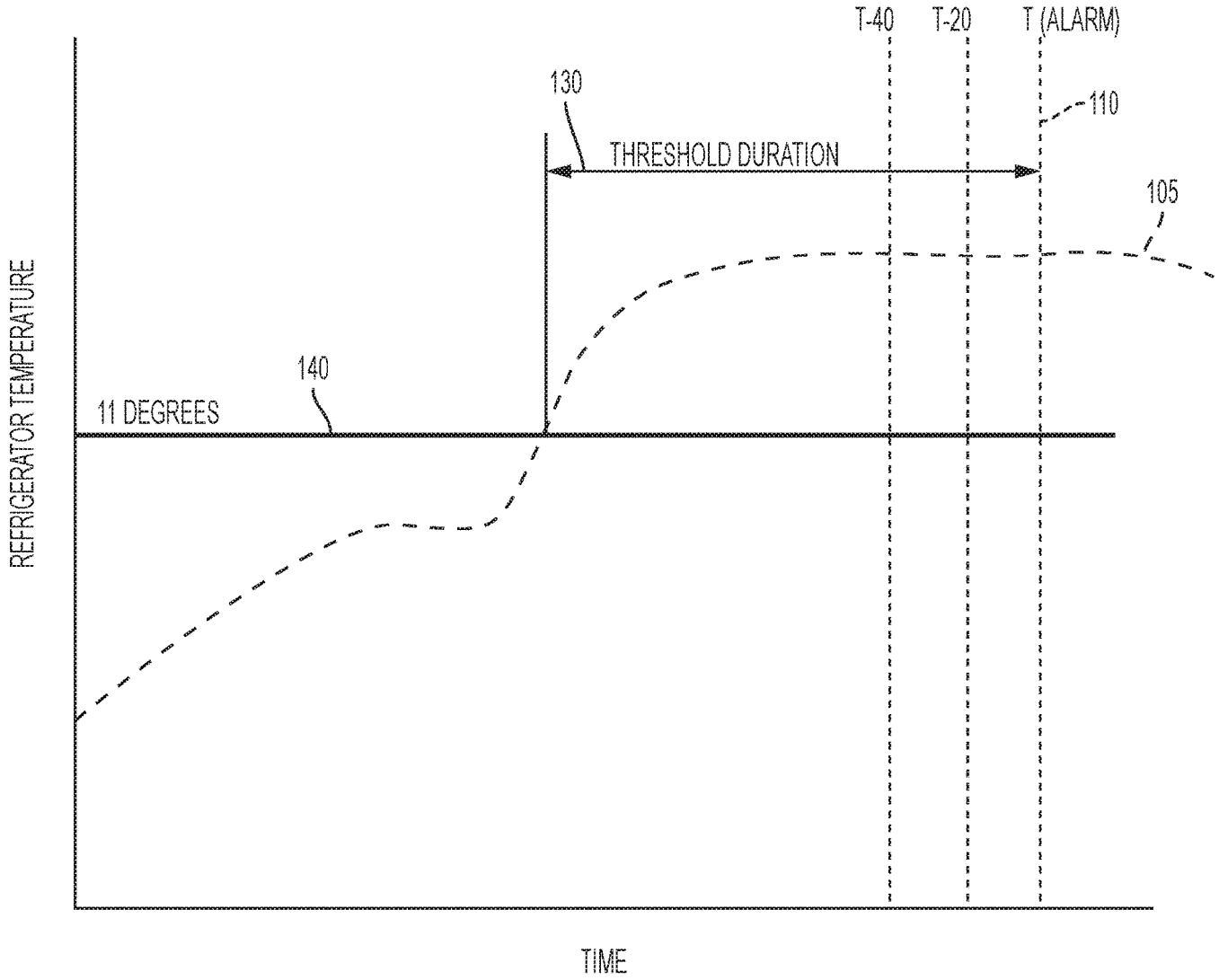
FIG. 1 illustrates how a temperature within a refrigeration system can trigger a temperature alarm in accordance with one or more embodiments of the invention.

Various embodiments of the invention are described herein with reference to the related drawings. Alternative embodiments of the invention can be devised without departing from the scope of this invention. References in the specification to "one embodiment," "an embodiment," "an example embodiment," etc., indicate that the embodiment described can include a particular feature, structure, or characteristic, but every embodiment may or may not include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments of the invention whether or not explicitly described.

Additionally, although this disclosure includes a detailed description of a computing device configuration, implementation of the teachings recited herein are not limited to a particular type or configuration of computing device(s). Rather, embodiments of the present disclosure are capable of being implemented in conjunction with any other type or configuration of wireless or non-wireless computing devices and/or computing environments, now known or later developed.

The following definitions and abbreviations are to be used for the interpretation of the claims and the specification. As used herein, the terms "comprises," "comprising," "includes," "including," "has," "having," "contains" or "containing," or any other variation thereof, are intended to cover a non-exclusive inclusion. For example, a composition, a mixture, process, method, article, or apparatus that comprises a list of elements is not necessarily limited to only those elements but can include other elements not expressly listed or inherent to such composition, mixture, process, method, article, or apparatus.

Additionally, the term "exemplary" is used herein to mean "serving as an example, instance or illustration." Any embodiment or design described herein as "exemplary" is not necessarily to be construed as preferred or advantageous over other embodiments of the invention or designs. The terms "at least one" and "one or more" are understood to include any integer number greater than or equal to one, i.e. one, two, three, four, etc. The terms "a plurality" are understood to include any integer number greater than or equal to two, i.e. two, three, four, five, etc. The term "connection" can include an indirect "connection" and a direct "connection."

For the sake of brevity, conventional techniques related to computer processing systems and computing models may or may not be described in detail herein. Moreover, it is understood that the various tasks and process steps described herein can be incorporated into a more comprehensive procedure, process or system having additional steps or functionality not described in detail herein.

One or more embodiments of the invention are directed to predicting when a temperature alarm will be triggered, where the temperature alarm is triggered based on a temperature fluctuation that occurs within a refrigerator system. For example, the temperature alarm can be triggered if the temperature within the refrigerator system exceeds a threshold temperature for a certain duration of time, for example. The refrigerator system can be a system of a retail store. Retail stores generally use temperature alarms to ensure that stored food is refrigerated at a proper temperature. By predicting when a temperature alarm will be triggered, retail stores can take preemptive action to correct any temperature fluctuation and thus can ensure that the stored food does not experience spoilage.

One conventional approach (for predicting when a temperature alarm is going to be triggered) performs analysis of time-series data in order to predict a future temperature within the refrigeration system. This conventional approach can analyze the time-series data using Holt, Winter, and autoregressive integrated moving average (ARIMA) techniques, for example. Time-series data generally refers to data that is sequentially arranged/ordered. Specifically, one example of time-series data can be temperature measurements that are measured (from within a refrigerator system) at successive points in time. When attempting to predict the temperature within the refrigeration system (and to thus predict when the alarm will be triggered), this conventional approach can accurately predict the temperature only if the temperature is characterized by gradual changes that occur over a long duration of time. In other words, this conventional approach cannot accurately predict the refrigeration temperature if the temperature can be dramatically affected by a random occurrence in a short amount of time. Examples of such random occurrences can include but are not limited to, a door of the refrigerator system being accidently left open, a sudden malfunction of an internal component within the refrigeration system, and/or a sudden blockage of a cool air vent that performs a cooling function within the refrigeration system.

In contrast to predicting a refrigerator temperature (and predicting a triggering of an alarm) based on analyzing time-series data, another conventional approach can predict when a temperature alarm will be triggered by analyzing patterns within parametric data. This type of conventional approach can use predictive models that implement, for example, logistic regression, chi-square automatic interaction detection (CHAID), and C5.0 algorithms to analyze the patterns within the parametric data. By analyzing the patterns, this conventional approach can predict temperatures that are suddenly affected by random events. However, although this conventional approach can predict refrigeration temperatures that have suddenly changed and can also determine the amount of time spent at each temperature, this conventional approach is able to predict when an alarm is triggered only if each possible temperature and time combination that triggers the alarm is defined and known.

In view of the shortcomings of the above-described conventional approaches, there is a need for a predictive system that can analyze a combination of time-series data and parametric data in order to predict when a temperature alarm will be triggered. One or more embodiments of the invention are directed to predicting when the temperature alarm will be triggered. The temperature alarm can be triggered when the temperature within the refrigeration system has exceeded a threshold temperature for a duration of time.

FIG. 1 illustrates how a temperature within a refrigeration system can trigger a temperature alarm in accordance with one or more embodiments of the invention. In the example of FIG. 1, the system triggers an alarm at time 110 when the temperature 105 within the refrigerator exceeds a predetermined threshold temperature 140 (of 11° F., for example) for a threshold duration of time 130. In the example of FIG. 1, because the temperature 105 within the refrigerator has remained above the acceptable threshold temperature 140 for the threshold duration of time 130, food that is stored within the refrigerator can possibly experience spoilage, and thus the alarm should be triggered at time 110. In the example of FIG. 1, it may be desirable to predict whether the alarm will be triggered before the alarm is actually triggered. By predicting that the alarm is going to be triggered ahead of time, such as performing the predicting at a point in time 20 minutes or 40 minutes prior to the actual triggering of the alarm (i.e., at "t−20" and "t−40"), a user can take preemptive measures to prevent the stored food from spoiling.

As discussed above, one or more embodiments of the invention can predict when an alarm will be triggered based on a threshold duration of time that the refrigeration temperature exceeds a threshold temperature. One or more embodiments of the invention can also determine the threshold duration of time based on how much the refrigeration temperature exceeds the threshold temperature. For example, if the temperature inside the refrigerator exceeds the acceptable threshold temperature by 4° F., then the food can experience spoilage in 80 minutes. On the other hand, if the temperature inside the refrigerator exceeds the acceptable threshold temperature by 9° F., then the food can experience spoilage much earlier (such as in, for example, 30 minutes). Therefore, the threshold duration of time can be dependent on how much the refrigeration temperature exceeds the threshold temperature, as illustrated by FIG. 2.

FIG. 2 illustrates a chart that reflects different possible amounts of temperature by which the refrigeration temperature can exceed a threshold temperature along with the corresponding threshold durations in accordance with one or more embodiments of the invention. For example, as reflected by the example of FIG. 2, if the refrigeration temperature exceeds the threshold temperature by 1° F., then the corresponding threshold duration is 110 minutes. In other words, if the refrigeration temperature exceeds the threshold temperature by 1° F. for a duration of 110 minutes, then the food can begin to experience spoilage. Thus, an alarm should be triggered at a time period corresponding to 110 minutes if the refrigeration temperature exceeds the threshold temperature by 1° F. As another example shown in FIG. 2, if the refrigeration temperature exceeds the threshold temperature by 9° F., then the corresponding threshold duration is 30 minutes. One or more embodiments can express the relationship between the excess temperature amount and the duration as a mathematical function, as illustrated by FIG. 3.

Figure 3:
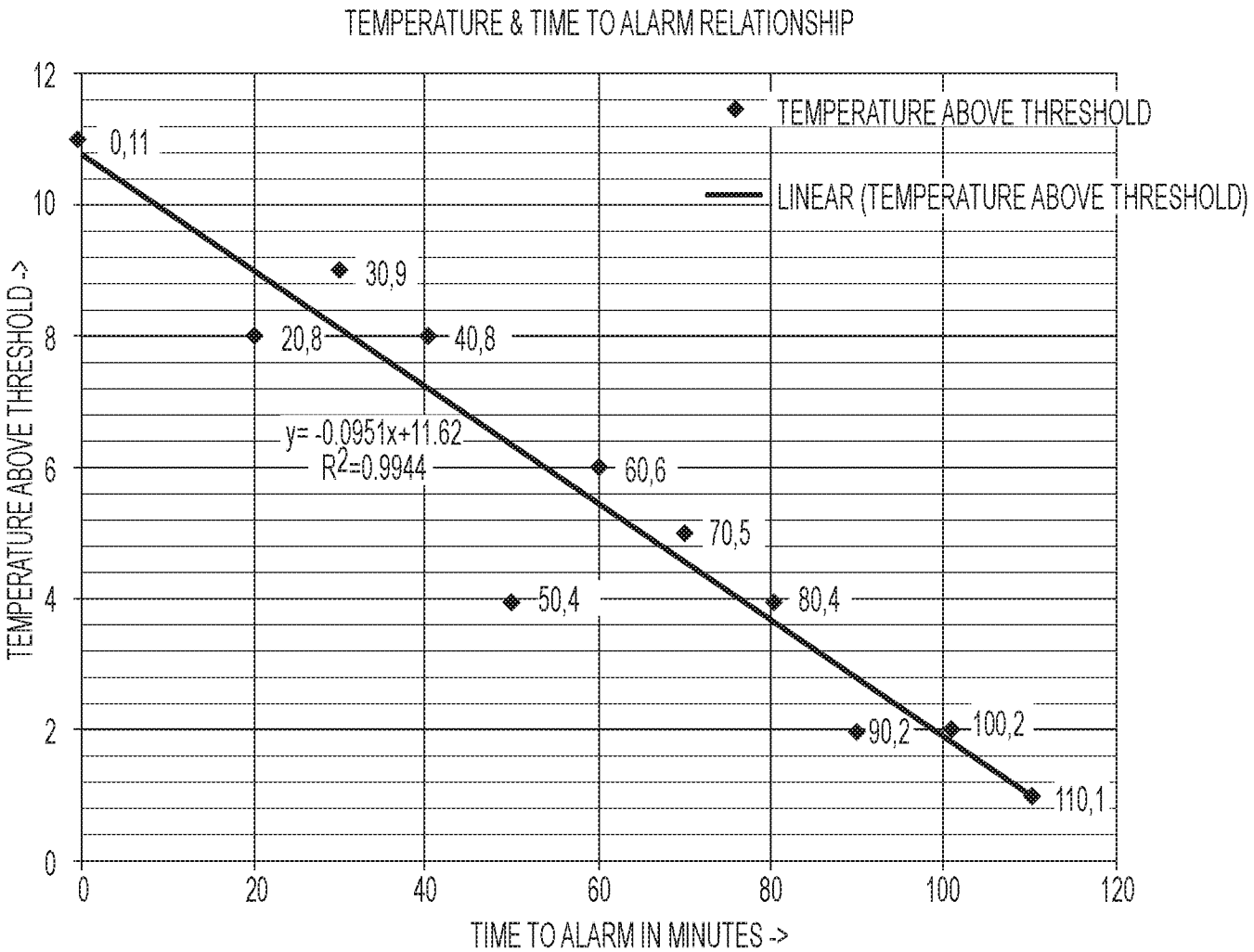
FIG. 3 illustrates performing curve fitting to determine a mathematical function that represents a relationship between different possible amounts of excess temperature and corresponding threshold durations in accordance with one or more embodiments of the invention.

FIG. 3 illustrates performing curve fitting to determine a mathematical function that represents the relationship between different possible amounts of excess temperature and corresponding threshold durations in accordance with one or more embodiments of the invention. Referring to FIG. 3, if each amount of excess temperature and corresponding time duration is positioned within the graph (with the time duration being represented along the x-axis and with the excess temperature being represented along the y-axis), then a mathematical relationship between the time and temperature can become apparent. In the example of FIG. 3, the mathematical relationship can be a linear function in the form of:

$$Y=-0.0951(X)+11.62$$

The mathematical function can represent be a linear equation or a polynomial equation. In the example of a linear equation, the equation can take the following form:

$$C=mt+b$$

where "C" corresponds to an amount of temperature that a refrigeration temperature exceeds a threshold temperature, where "t" corresponds to a duration of time where the refrigeration temperature exceeds the threshold temperature (minutes), where "m" corresponds to a slope of the linear relationship, and where "b" corresponds to an intercept value of the mathematical function.

In the example of FIG. 3, the slope "m" and the intercept "b" can be calculated as follows:

$$\text{Slope of line}(m) = \frac{\sum (t-\bar{t})(C-\bar{C})}{\sum (t-t)^2}$$

and $$\text{Intercept}(b) = \bar{C} - m\bar{t}$$

where $\bar{t}$=average t $\bar{C}$=average C

Figure 4:
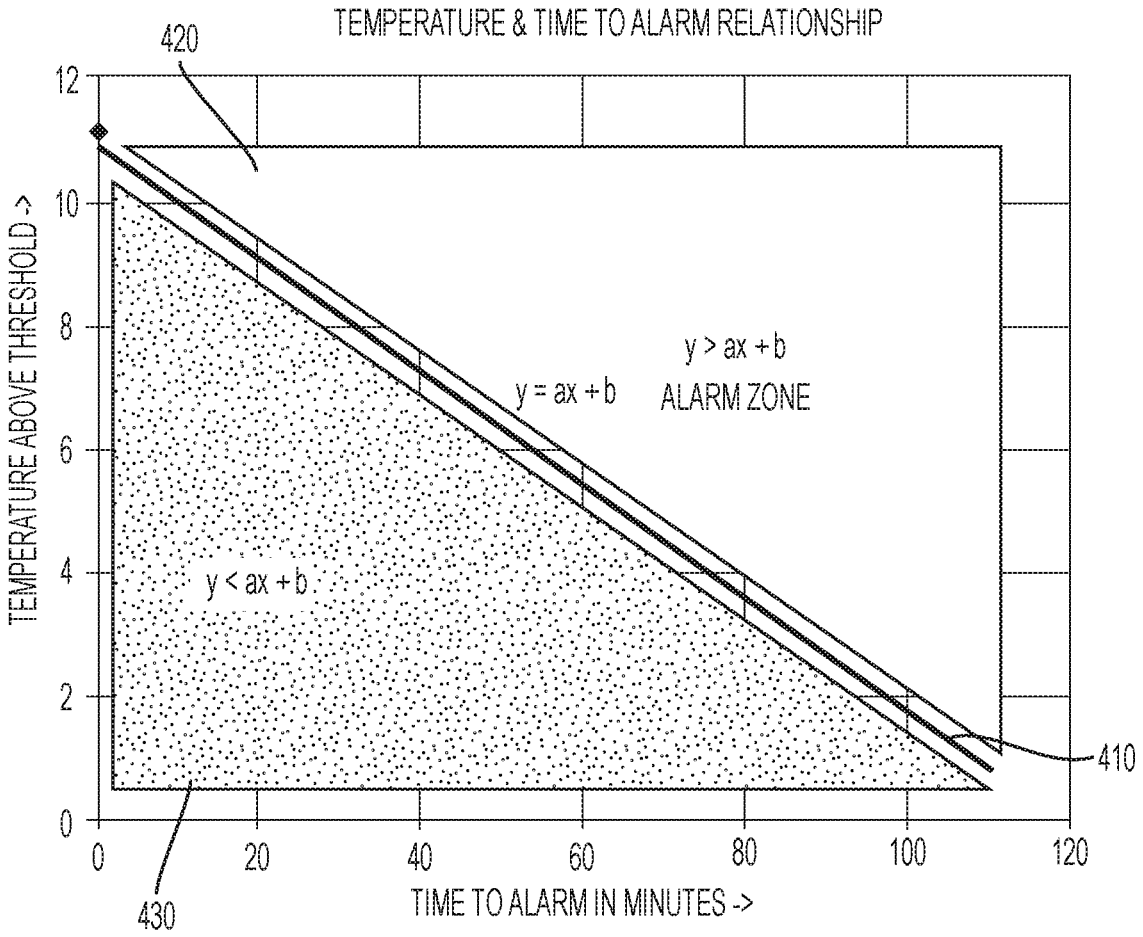
FIG. 4 illustrates an alarm zone and a non-alarm zone that are defined by the mathematical function in accordance with one or more embodiments of the invention.

The mathematical function can also define an alarm zone and a non-alarm zone. FIG. 4 illustrates an alarm zone and a non-alarm zone that are defined by the mathematical function in accordance with one or more embodiments of the invention. As previously described, the mathematical function that describes the relationship between the amount of excess temperature and the threshold duration of time can be a linear relationship. In the example of FIG. 4, the linear relationship can be represented by line 410, where line 410 defines an alarm zone 420 and a non-alarm zone 430 for different refrigeration states. Each refrigeration state includes (1) an amount of temperature by which the refrigerator temperature has exceeded a threshold temperature, and (2) a corresponding threshold duration by which the refrigerator temperature has exceeded the threshold temperature. Each refrigeration state that should trigger an alarm will be represented within the alarm zone 420, and each refrigeration state that should not trigger the alarm will be represented within the non-alarm zone 430.

Upon determining the alarm zone 420 and the non-alarm zone 430, one or more embodiments of the invention can then use a predictive model in order to predict whether an alarm will be triggered. Specifically, one or more embodiments of the invention can predict whether the future state of the refrigeration system will be a refrigeration state that is within the alarm zone or that is within the non-alarm zone. In one or more embodiments of the invention, the predictive model can predict the future state of the refrigeration system based on one or more parameters that relate to the current state of the refrigeration system. For example, in one or more embodiments of the invention, the predictive model can perform regression on one or more parameters relating to the current state. With one embodiment of the invention, the predictive model can perform a linear regression on one or more parameters to predict the future state of the refrigeration system.

Specifically, the predictive model of one or more embodiments can perform a prediction of the future state based on one or more of the following parameters that relate to the current state of the refrigeration system: (1) a number of times that a threshold temperature has been exceeded, (2) a duration of time that the threshold temperature has been exceeded, (3) a change in temperature (expressed as a percentage) over a period of time, (3) an average temperature, (4) an amount of temperature that the threshold temperature has been exceeded, (5) an average suction pressure resulting from a compressor, (6) an amount of time that has been spent defrosting the refrigeration system, and/or (7) a number of times when a defroster was activated. Each of the above-described parameters can be evaluated over a short-term time period and/or a long-term time period. With one or more embodiments of the invention, the predictive model can be implemented by one or more computer controllers/processors of the refrigeration system. The processors can be special-purpose processors that are configured to perform the above-described functions. The refrigeration system can also include one or more temperature sensors, refrigeration timers, compressors, evaporator fans, and/or suction-pressure sensors. One or more temperature sensors of the refrigeration system can measure a temperature or a temperature change within the refrigeration system, and these temperature sensors can be interconnected with the controllers/processors. The temperature sensors can measure temperature and can input the measurements into the predictive model. With one or more embodiments of the invention, a refrigeration timer can be interconnected with and/or operate in conjunction with the controllers/processors in order to input time measurements into the predictive model. With one or more embodiments of the invention, a suction-pressure sensor can be interconnected with and/or operate in conjunction with the controllers/processors in order to input suction-pressure measurements into the predictive model.

With one or more embodiments of the invention, the predictive model can determine a temperature trend as shown below:

$$T_t(\text{trend at } t) = \left\{\frac{C_t - C_{t-x}}{C_{t-x}}\right\}$$

where "$C_t$" corresponds to the refrigeration temperature at time "t," and where "$C_{t-x}$" corresponds to the refrigeration temperature at time "t-x."

By determining a temperature trend, one or more embodiments of the invention can then extrapolate the determined trend over a duration of time to determine a predicted future temperature that is predicted to exist at the end of the extrapolated duration of time. The predicted future temperature (and the duration of time that the refrigeration temperature stays at the predicted future temperature) defines the predicted future state of the refrigeration system. One or more embodiments of the invention can determine whether the predicted future state falls within the alarm zone or within the non-alarm zone.

Specifically, upon determining the predicted future state of the refrigeration system, one or more embodiments determine whether the predicted future state falls within the alarm zone or the non-alarm zone, as defined by the mathematical function. For instance, suppose that one or more embodiments of the invention seek to determine whether a predicted future state of the refrigerator system falls within the non-alarm zone or the alarm zone that was defined by the linear function of FIG. 3 (i.e., Y=−0.0951(X)+11.62). Suppose that the predicted future state includes: (1) an amount of temperature (in excess of the threshold temperature) is 13° F., and (2) a given duration of time of 3 minutes (that the refrigeration temperature exceeds the threshold temperature by 13° F.). In this example, in order for the predicted future state of the refrigerator system to fall within the non-alarm zone, given the duration of time is 3 minutes, the maximum amount of temperature that the refrigeration temperature can exceed the threshold temperature is 11.3347° F. (which corresponds to (−0.0951×3)+11.62). If the predicted future temperature is less than 11.3347° F., then the predicted future state of the refrigeration system falls within the non-alarm zone. On the other hand, if the predicted future temperature is greater than 11.3347° F., then the predicted future state of the refrigeration system falls within the alarm zone. In the present example, because the predicted future temperature is 13° F., which is greater than 11.3347° F., the predicted future state of the refrigeration system falls within the alarm zone.

If the predicted future state falls within the alarm zone, then one or more embodiments of the invention predict that the temperature alarm will be triggered. On the other hand, if the predicted future state falls within the non-alarm zone, then one or more embodiments of the invention predict that the temperature alarm will not be triggered. If the temperature alarm is predicted to be triggered, then one or more embodiments of the invention can trigger one or more compressors to improve a cooling effect. The triggered compressor can be a compressor of the refrigeration system itself. Alternatively, the refrigeration system can trigger a compressor that belongs to a different refrigeration system that is connected in parallel to the present refrigeration system, where the triggered compressor can provide cooling to both refrigeration systems. With one or more embodiments of the invention, if the temperature alarm is predicted to be triggered, then one or more embodiments of the invention can trigger one or more compressors to modify a suction pressure. If the temperature alarm is predicted to be triggered, one or more embodiments can also trigger an evaporator fan to provide a cooling effect.

In view of the above, one or more embodiments of the invention can use the above-described predictive model to determine operation of one or more compressors, where the predictive model controls the one or more compressors in an unconventional manner based on the unconventional prediction of whether a temperature alarm will be triggered.

Figure 5:
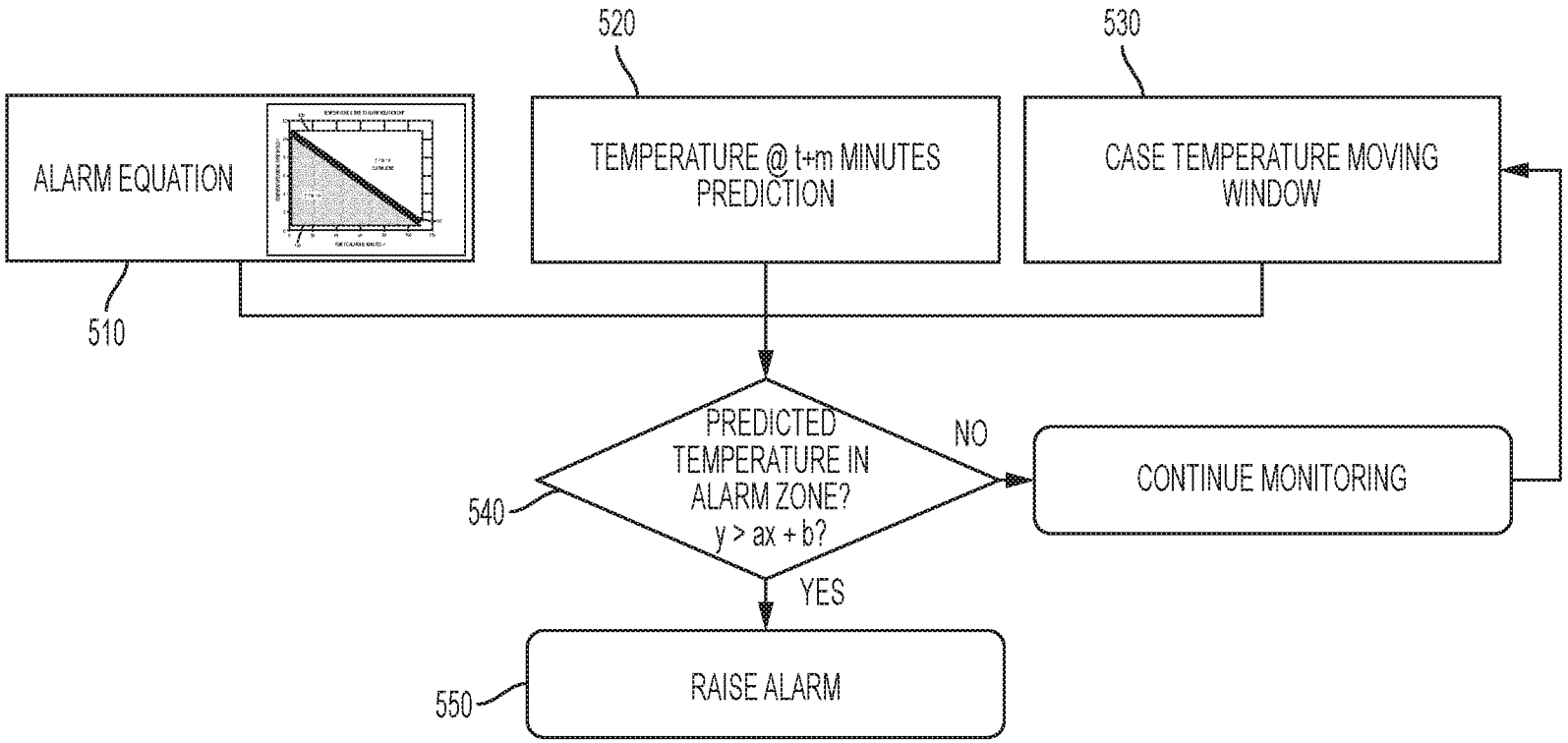
FIG. 5 illustrates a method that predicts whether a temperature alarm will be triggered in accordance with one or more embodiments of the invention.

FIG. 5 illustrates a method that predicts whether a temperature alarm will be triggered in accordance with one or more embodiments of the invention. At step 510, one or more embodiments of the invention determine a mathematical function/equation that defines the relationship between (1) an amount of excess temperature that a refrigeration temperature is over a threshold temperature, and (2) a duration of time that the refrigeration temperature remains at the excessive temperature. This mathematical function/equation can also be referred to as an "alarm equation" because the function/equation defines at least an alarm zone and a non-alarm zone. At step 520, one or more embodiments of the invention use a predictive model in order to predict the future state of the refrigeration system. For example, one or more embodiments can use the predictive model in order to predict a temperature "m" minutes into the future. At step 530, one or more embodiments of the invention define a time frame for the prediction of the future state of the refrigeration system. The time frame can be a moving window of time that is continually adjusted. At 540, one or more embodiments of the invention determine whether the predicted state of the refrigeration system is within the alarm zone. Specifically, given a predicted temperature at "t+m" minutes, one or more embodiments can determine whether the predicted temperature is in the alarm zone. If the predicted state of the refrigeration system is not within the alarm zone, then one or more embodiments can continue monitoring. If the predicted state of the refrigeration system is within the alarm zone, then one or more embodiments predict, at 550, that the alarm will be triggered.

Figure 6:
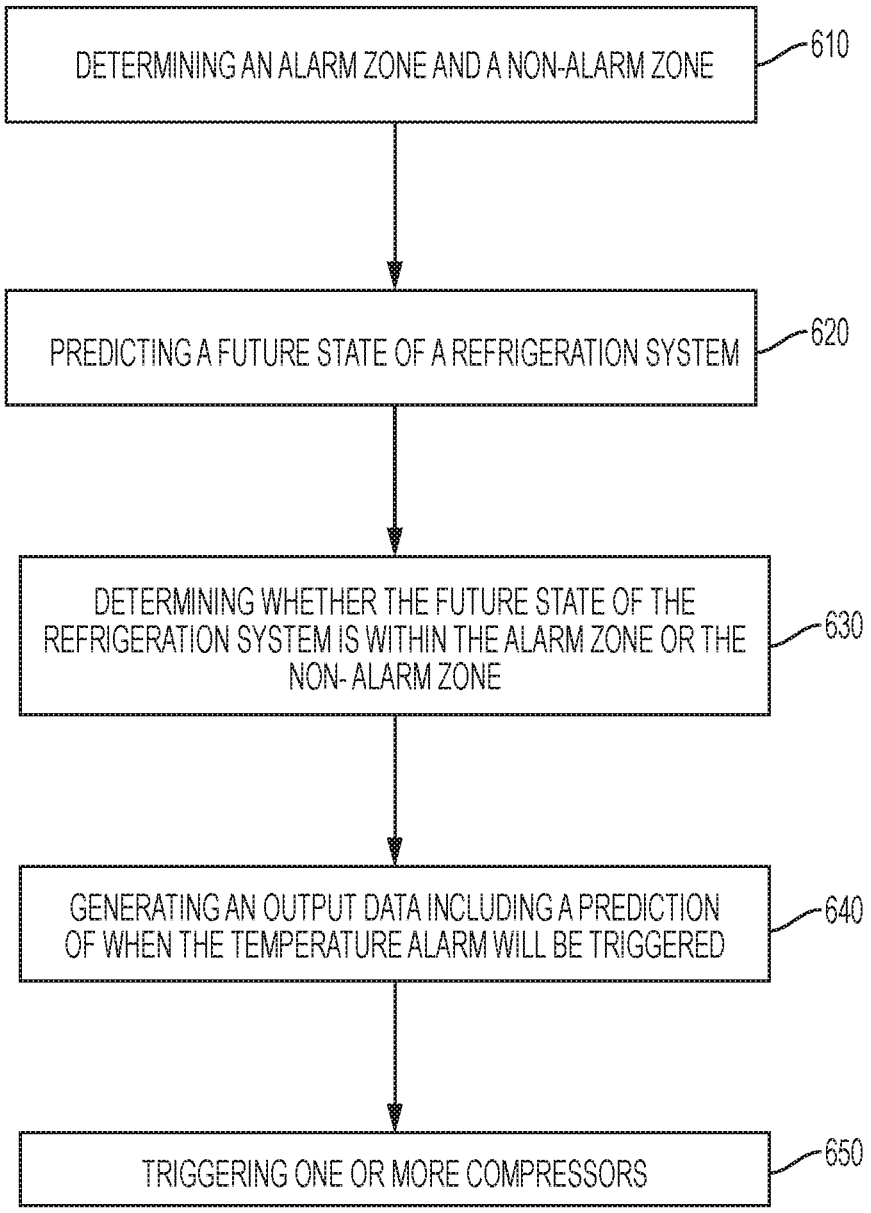
FIG. 6 depicts a flowchart of a method in accordance with one or more embodiments of the invention.

FIG. 6 depicts a flowchart of a method in accordance with one or more embodiments of the invention. The method of FIG. 6 can be performed by a controller of a system that is configured to predict a triggering of a temperature alarm based on a predicted state of a refrigeration system.

The method includes, at block 610, determining, by a controller of a refrigeration system, an alarm zone, and a non-alarm zone. The alarm zone corresponds to possible states of the refrigeration system that trigger a temperature alarm of the refrigeration system, and the non-alarm zone corresponds to possible states of the refrigeration system that do not trigger the temperature alarm. The method also includes, at block 620, predicting a future state of the refrigeration system. The future state can be predicted based on at least one input determined by a temperature sensor of the refrigeration system, and the future state can be predicted based on at least one input determined by a timer of the refrigeration system. The method also includes, at block 630, determining whether the future state of the refrigeration system is within the alarm zone or the non-alarm zone. The method also includes, at block 640, generating, by the controller, an output data comprising a prediction of when the temperature alarm will be triggered. The generating is based on whether the future state of the refrigeration system is determined to be within the alarm zone or the non-alarm zone. The method can also include, at 650, triggering one or more compressors connected to the refrigeration system to improve a cooling effect.

Figure 7:
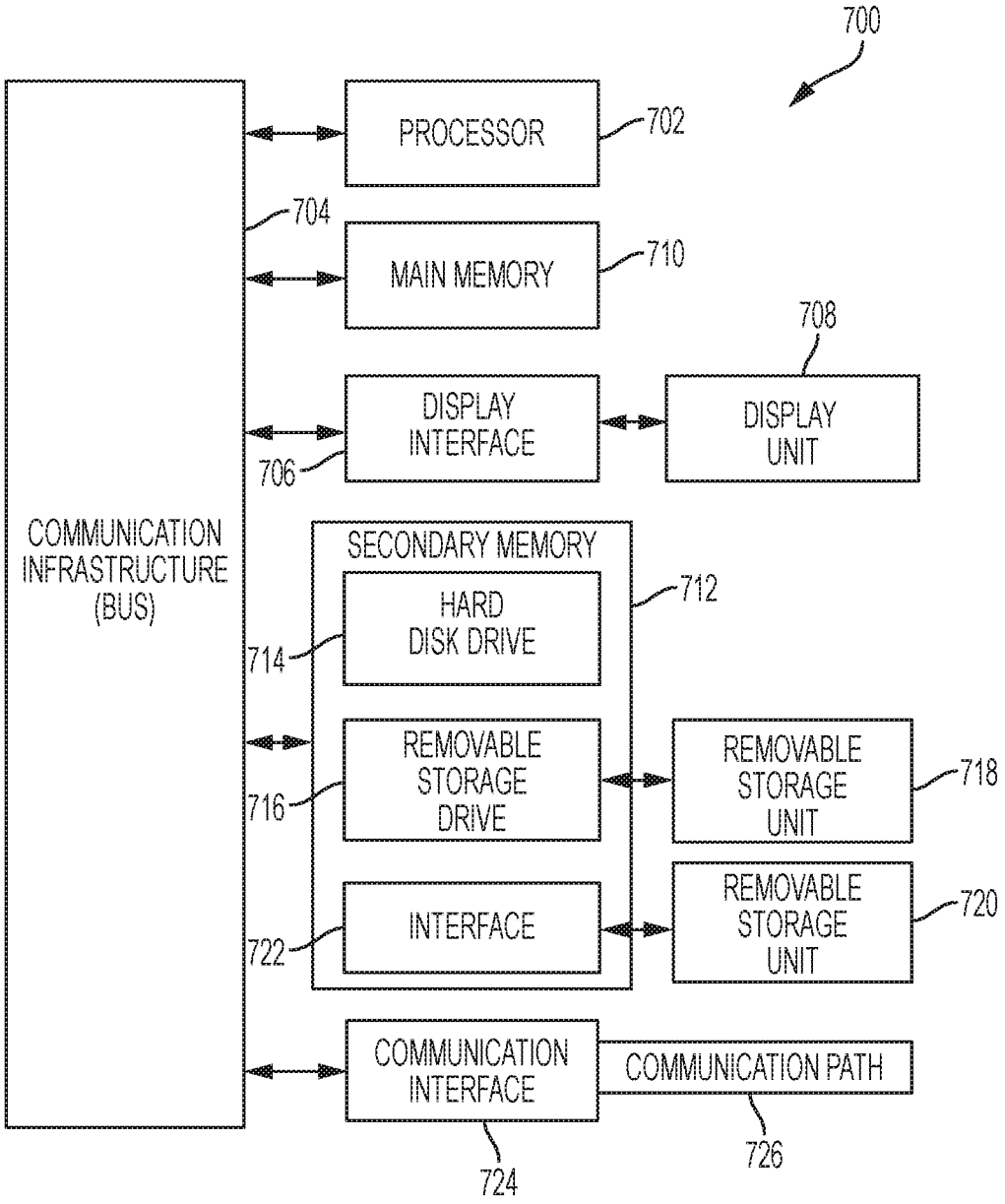
FIG. 7 depicts a high-level block diagram of a computer system, which can be used to implement one or more embodiments of the invention.

FIG. 7 depicts a high-level block diagram of a computer system 700, which can be used to implement one or more embodiments of the invention. Computer system 700 can correspond to or operate in conjunction with, at least, a retail refrigeration system, for example. Computer system 700 can be used to implement hardware components of systems capable of performing methods described herein. Although one exemplary computer system 700 is shown, computer system 700 includes a communication path 726, which connects computer system 700 to additional systems (not depicted) and can include one or more wide area networks (WANs) and/or local area networks (LANs) such as the Internet, intranet(s), and/or wireless communication network(s). Computer system 700 and additional system are in communication via communication path 726, e.g., to communicate data between them.

Computer system 700 includes one or more processors, such as processor 702. Processor 702 is connected to a communication infrastructure 704 (e.g., a communications bus, cross-over bar, or network). Computer system 700 can include a display interface 706 that forwards graphics, textual content, and other data from communication infrastructure 704 (or from a frame buffer not shown) for display on a display unit 708. Computer system 700 also includes a main memory 710, preferably random access memory (RAM), and can also include a secondary memory 712. Secondary memory 712 can include, for example, a hard disk drive 714 and/or a removable storage drive 716, representing, for example, a floppy disk drive, a magnetic tape drive, or an optical disc drive. Hard disk drive 714 can be in the form of a solid state drive (SSD), a traditional magnetic disk drive, or a hybrid of the two. There also can be more than one hard disk drive 714 contained within secondary memory 712. Removable storage drive 716 reads from and/or writes to a removable storage unit 718 in a manner well known to those having ordinary skill in the art. Removable storage unit 718 represents, for example, a floppy disk, a compact disc, a magnetic tape, or an optical disc, etc. which is read by and written to by removable storage drive 716. As will be appreciated, removable storage unit 718 includes a computer-readable medium having stored therein computer software and/or data.

In alternative embodiments of the invention, secondary memory 712 can include other similar means for allowing computer programs or other instructions to be loaded into the computer system. Such means can include, for example, a removable storage unit 720 and an interface 722. Examples of such means can include a program package and package interface (such as that found in video game devices), a removable memory chip (such as an EPROM, secure digital card (SD card), compact flash card (CF card), universal serial bus (USB) memory, or PROM) and associated socket, and other removable storage units 720 and interfaces 722 which allow software and data to be transferred from the removable storage unit 720 to computer system 700.

Computer system 700 can also include a communications interface 724. Communications interface 724 allows software and data to be transferred between the computer system and external devices. Examples of communications interface 724 can include a modem, a network interface (such as an Ethernet card), a communications port, or a PC card slot and card, a universal serial bus port (USB), and the like. Software and data transferred via communications interface 724 are in the form of signals that can be, for example, electronic, electromagnetic, optical, or other signals capable of being received by communications interface 724. These signals are provided to communications interface 724 via a communication path (i.e., channel) 726. Communication path 726 carries signals and can be implemented using wire or cable, fiber optics, a phone line, a cellular phone link, an RF link, and/or other communications channels.

In the present description, the terms "computer program medium," "computer usable medium," and "computer-readable medium" are used to refer to media such as main memory 710 and secondary memory 712, removable storage drive 716, and a hard disk installed in hard disk drive 714. Computer programs (also called computer control logic) are stored in main memory 710 and/or secondary memory 712. Computer programs also can be received via communications interface 724. Such computer programs, when run, enable the computer system to perform the features discussed herein. In particular, the computer programs, when run, enable processor 702 to perform the features of the computer system. Accordingly, such computer programs represent controllers of the computer system. Thus it can be seen from the foregoing detailed description that one or more embodiments of the invention provide technical benefits and advantages.

The terms "about," "substantially," "approximately," and variations thereof, are intended to include the degree of error associated with measurement of the particular quantity based upon the equipment available at the time of filing the application. For example, "about" can include a range of ±8% or 5%, or 2% of a given value.

Figure 8:
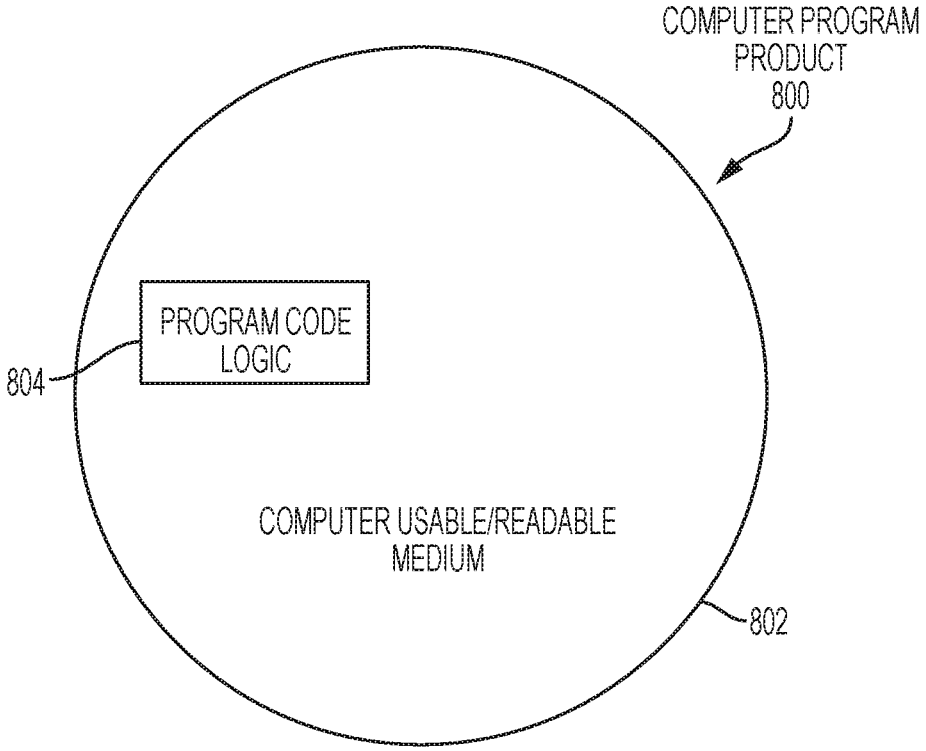
FIG. 8 depicts a computer program product, in accordance with an embodiment of the invention.

FIG. 8 depicts a computer program product 800, in accordance with an embodiment of the invention. Computer program product 800 includes a computer-readable storage medium 802 and program instructions 804.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments of the invention, electronic circuitry including, for example, programmable logic circuitry, field-programmable gate arrays (FPGA), or programmable logic arrays (PLA) may execute the computer readable program instruction by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments described herein.

What is claimed is:

1. A computer-implemented method comprising:

determining, by a controller of a refrigeration system, an alarm zone and a non-alarm zone, wherein the alarm zone corresponds to possible states of the refrigeration system that trigger a temperature alarm of the refrigeration system, and the non-alarm zone corresponds to possible states of the refrigeration system that do not trigger the temperature alarm;

predicting a future state of the refrigeration system, wherein the future state is predicted based on at least one input determined by a temperature sensor of the refrigeration system, and the future state is predicted based on at least one input determined by a timer of the refrigeration system;

determining whether the future state of the refrigeration system is within the alarm zone or the non-alarm zone;

generating, by the controller, an output data comprising a prediction of when the temperature alarm will be triggered, wherein the generating is based on whether the future state of the refrigeration system is determined to be within the alarm zone or the non-alarm zone; and triggering one or more compressors connected to the refrigeration system to improve a cooling effect, wherein the one or more compressors are triggered prior to a predicted time of when the temperature alarm will be triggered wherein the predicting the future state of the refrigeration system comprises performing regression on one or more parameters relating to a current state of the refrigeration system, wherein the one or more parameters include a number of times that a threshold temperature has been exceeded, a duration of time that the threshold temperature was exceeded, and a change in temperature over the duration of time.

2. The computer-implemented method of claim 1, wherein the determining the alarm zone and the non-alarm zone comprises performing curve fitting to determine a relationship between an amount of temperature that the refrigeration system exceeds a threshold temperature and a corresponding threshold duration.

3. The computer-implemented method of claim 2, wherein the determined relationship comprises a linear function.

4. The computer-implemented method of claim 2, wherein the determined relationship comprises a polynomial function.

5. The computer-implemented method of claim 1, wherein predicting the future state comprises extrapolating a temperature trend to determine a predicted future temperature.

6. A computer system comprising:

a memory; and a processor system of a refrigeration system communicatively coupled to the memory;

the processor system configured to perform a method comprising:

determining an alarm zone and a non-alarm zone, wherein the alarm zone corresponds to possible states of the refrigeration system that trigger a temperature alarm of the refrigeration system, and the non-alarm zone corresponds to possible states of the refrigeration system that do not trigger the temperature alarm;

predicting a future state of the refrigeration system, wherein the future state is predicted based on at least one input determined by a temperature sensor of the refrigeration system, and the future state is predicted based on at least one input determined by a timer of the refrigeration system;

determining whether the future state of the refrigeration system is within the alarm zone or the non-alarm zone;

generating an output data comprising a prediction of when the temperature alarm will be triggered, wherein the generating is based on whether the future state of the refrigeration system is determined to be within the alarm zone or the non-alarm zone; and triggering one or more compressors connected to the refrigeration system to improve a cooling effect, wherein the one or more compressors are triggered prior to a predicted time of when the temperature alarm will be triggered wherein the predicting the future state of the refrigeration system comprises performing regression on one or more parameters relating to a current state of the refrigeration system, wherein the one or more parameters include a number of times that a threshold temperature has been exceeded, a duration of time that the threshold temperature was exceeded, and a change in temperature over the duration of time.

7. The computer system of claim 6, wherein the determining the alarm zone and the non-alarm zone comprises performing curve fitting to determine a relationship between an amount of temperature that the refrigeration system exceeds a threshold temperature and a corresponding threshold duration.

8. The computer system of claim 7, wherein the determined relationship comprises a linear function.

9. The computer system of claim 7, wherein the determined relationship comprises a polynomial function.

10. The computer system of claim 6, wherein predicting the future state comprises extrapolating a temperature trend to determine a predicted future temperature.

11. A computer program product comprising a non-transitory computer-readable storage medium having program instructions embodied therewith, the program instructions readable by a processor system of a refrigeration system to cause the processor system to:

determine an alarm zone and a non-alarm zone, wherein the alarm zone corresponds to possible states of the refrigeration system that trigger a temperature alarm of the refrigeration system, and the non-alarm zone corresponds to possible states of the refrigeration system that do not trigger the temperature alarm;

predict a future state of the refrigeration system, wherein the future state is predicted based on at least one input determined by a temperature sensor of the refrigeration system, and the future state is predicted based on at least one input determined by a timer of the refrigeration system;

determine whether the future state of the refrigeration system is within the alarm zone or the non-alarm zone;

generate an output data comprising a prediction of when the temperature alarm will be triggered, wherein the generating is based on whether the future state of the refrigeration system is determined to be within the alarm zone or the non-alarm zone; and trigger one or more compressors connected to the refrigeration system to improve a cooling effect, wherein the one or more compressors are triggered prior to a predicted time of when the temperature alarm will be triggered wherein the predicting the future state of the refrigeration system comprises performing regression on one or more parameters relating to a current state of the refrigeration system, wherein the one or more parameters include a number of times that a threshold temperature has been exceeded, a duration of time that the threshold temperature was exceeded, and a change in temperature over the duration of time.

12. The computer program product of claim 11, wherein the determining the alarm zone and the non-alarm zone comprises performing curve fitting to determine a relationship between an amount of temperature that the refrigeration system exceeds a threshold temperature and a corresponding threshold duration.

13. The computer program product of claim 12, wherein the determined relationship comprises a linear function.

14. The computer program product of claim 12, wherein the determined relationship comprises a polynomial function.

* * * * *